US009447641B2

(12) United States Patent
Liu et al.

(10) Patent No.: US 9,447,641 B2
(45) Date of Patent: Sep. 20, 2016

(54) ROTARY STEERABLE DRILLING TOOL WITH A LINEAR MOTOR

(71) Applicants: Naizhen Liu, Beijing (CN); Qihui Zhao, Beijing (CN); Yuzhou Lu, Beijing (CN); Yonghe Li, Panjin (CN); Rui Bai, Panjin (CN); Jing Li, Houston, TX (US); Ce Liu, Houston, TX (US)

(72) Inventors: Naizhen Liu, Beijing (CN); Qihui Zhao, Beijing (CN); Yuzhou Lu, Beijing (CN); Yonghe Li, Panjin (CN); Rui Bai, Panjin (CN); Jing Li, Houston, TX (US); Ce Liu, Houston, TX (US)

( * ) Notice: Subject to any disclaimer, the term of this patent is extended or adjusted under 35 U.S.C. 154(b) by 137 days.

(21) Appl. No.: 14/280,195

(22) Filed: May 16, 2014

(65) Prior Publication Data

US 2014/0345944 A1 Nov. 27, 2014

Related U.S. Application Data

(60) Provisional application No. 61/826,373, filed on May 22, 2013.

(51) Int. Cl.

| | |
|---|---|
| ***E21B 7/06*** | (2006.01) |
| ***E21B 7/04*** | (2006.01) |
| ***E21B 17/02*** | (2006.01) |
| ***E21B 47/024*** | (2006.01) |

(52) U.S. Cl.

CPC ..... *E21B 7/067* (2013.01); *E21B 7/04* (2013.01); *E21B 7/068* (2013.01); *E21B 17/028* (2013.01); *E21B 47/024* (2013.01)

(58) Field of Classification Search

CPC ..... E21B 7/06; E21B 7/04; E21B 17/05; E21B 47/024; E21B 17/028

See application file for complete search history.

(56) References Cited

U.S. PATENT DOCUMENTS

| | | | | |
|---|---|---|---|---|
| 4,291,773 | A * | 9/1981 | Evans | E21B 4/00 175/320 |
| 5,484,029 | A * | 1/1996 | Eddison | E21B 7/067 175/50 |
| 6,092,610 | A * | 7/2000 | Kosmala | E21B 4/20 175/27 |
| 7,488,194 | B2 * | 2/2009 | Hall | E21B 4/145 439/191 |
| 9,057,223 | B2 * | 6/2015 | Perrin | E21B 7/04 |
| 2010/0175923 | A1 * | 7/2010 | Allan | E21B 47/024 175/45 |
| 2012/0118646 | A1 * | 5/2012 | Russell | E21B 4/02 175/73 |
| 2014/0048334 | A1 * | 2/2014 | Pabon | E21B 7/062 175/61 |
| 2014/0209389 | A1 * | 7/2014 | Sugiura | E21B 7/067 175/73 |

* cited by examiner

*Primary Examiner* — Shane Bomar

(74) *Attorney, Agent, or Firm* — Lai, Corsini & Lapus, LLP; Theodore Lapus

(57) ABSTRACT

A rotary steerable drilling tool with an electromagnetic steering system can include a drill collar, a bit shaft, an orientation control module, a mud tube, a mud tube coupler, a universal joint, a mud sealing device, and a drill bit. The bit shaft can be mechanically coupled to the drill collar through the universal joint and the orientation control module and rotate about the universal joint. The orientation and the inclination angle of the bit shaft against the drill collar can be controlled by the orientation control module with the electromagnetic steering system. The orientation control module can include a guide track mounted on the inside wall of the drill collar, arrays of electromagnets mounted on the guide track, a positioning frame, a permanent magnet mounted on the positioning frame, a coupling tube, and at least two bearing wheels. A corresponding electromagnetic steering method is also provided.

9 Claims, 10 Drawing Sheets

ROTARY STEERABLE DRILLING TOOL WITH A LINEAR MOTOR

FIELD

The present invention relates generally to apparatuses and methods for the directional drilling of wells, particularly wells for the production of petroleum products. More specifically, the present invention relates to a rotary steerable drilling tool with an electromagnetic steering system.

BACKGROUND

There are mainly two well-known types of systems for directional drilling of wells: 1) push-the-bit system; and 2) point-the-bit system. The push-the-bit system controls the well drilling direction by pushing the sidewall of the well at the opposite side against the designated drilling direction, as described in the U.S. Pat. No. 6,206,108 issued to MacDonald et al on Mar. 27, 2001. The point-the-bit system directly points the drill bit at the planned drilling direction, as described in the U.S. Pat. No. 6,092,610 issued to Alexandre G. E. Kosmala et al. on Jul. 25, 2000 and the U.S. Pat. App. No. 2002/0175003 published on Nov. 28, 2002 by Attilio C. Pisoni et al.

A point-the-bit system usually comprises of at least one bit shaft within the drilling collar. The bit shaft can be supported by a universal joint within the drilling collar and is rotatably driven by the drilling collar. For directional drilling purpose, the bit shaft must be maintained geostationary and axially inclined to the drilling collar during the drilling collar rotation. The point-the-bit system usually also incorporates a directional control method that the drill bit can be offset in the desired direction as the drilling tool rotates. However, the point-the-bit system requires complicated mechanical designs.

Therefore, a need exists for a rotary steerable drilling tool with simpler structure design.

A further need exists for a rotary steerable drilling tool with electromagnetic steering system to control the drilling direction.

The present embodiments of the present invention meet these needs and improve on the technology.

BRIEF DESCRIPTION OF THE DRAWINGS

The drawings described herein are for illustrating purposes only of selected embodiments and not all possible implementation and are not intended to limit the scope of the present disclosure.

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the present invention is not limited to the particular embodiments and that it can be practiced or carried out in various ways.

The present invention relates generally to apparatuses and methods for the directional drilling of wells, particularly wells for the production of petroleum products. More specifically, the present invention relates to a rotary steerable drilling tool with an electromagnetic steering system.

Figure 1:
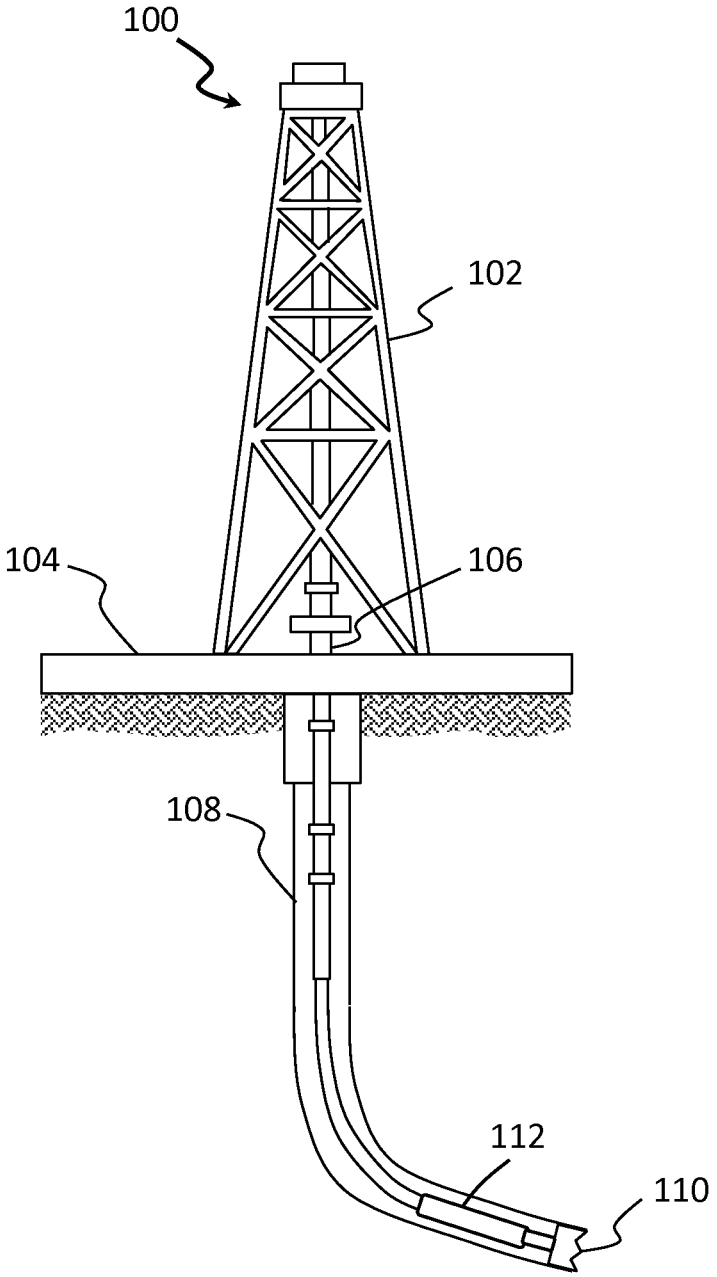
FIG. 1 illustrates a front view of a rotary steerable drilling system assembled with a conventional logging while drilling system.

FIG. 1 illustrates a front view of a rotary steerable drilling system 112 assembled with a conventional logging while drilling system 100 according to some embodiments of the present invention. The conventional logging while drilling system 100 can include a drilling rig 102, a drill string 106, a drilling bit 110, and a rotary steerable drilling system 112. The drill string 106 supported by the drilling rig 102 can extend from above a surface 104 down into a borehole 108. The drill string 106 can carry on the drilling bit 110 and the rotary steerable drilling system 112 to make directional drilling of wells.

Figure 2:
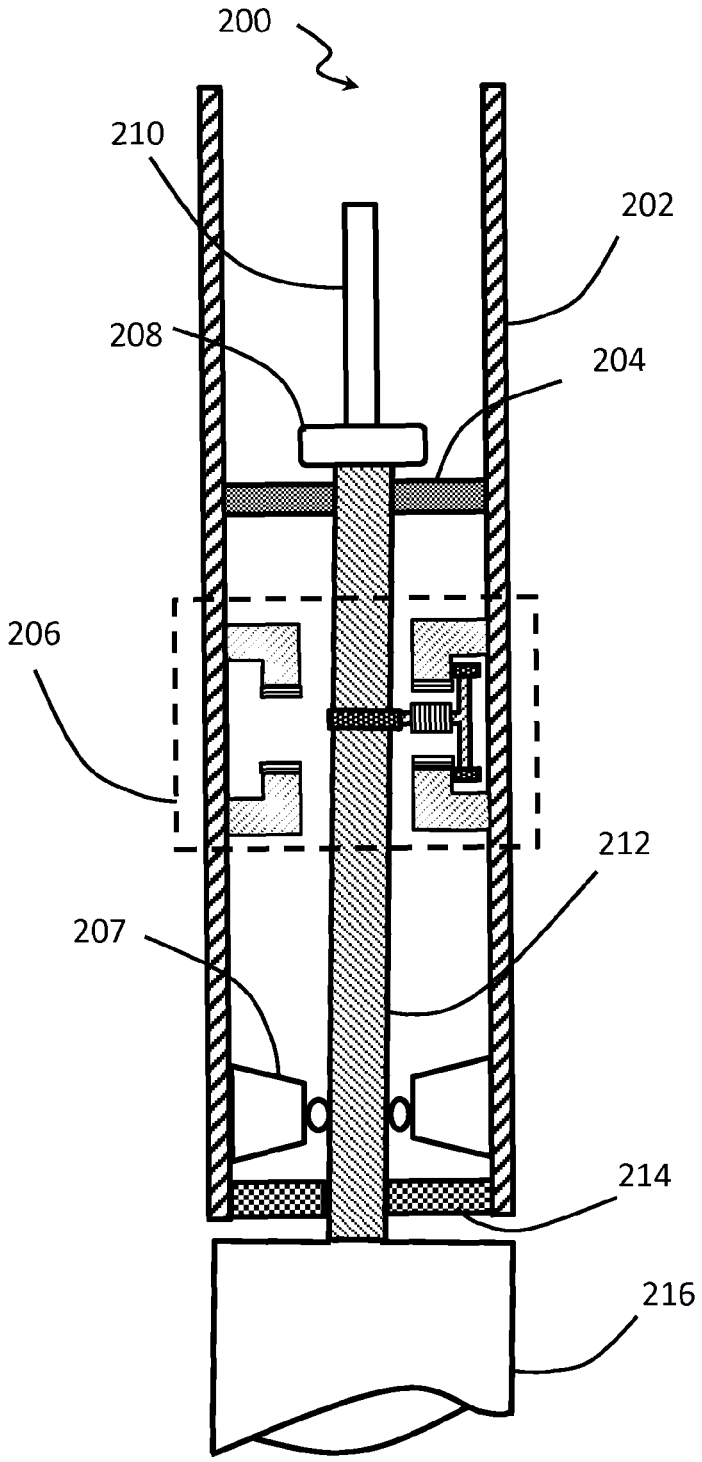
FIG. 2 illustrates a perspective view of a rotary steerable drilling tool with an electromagnetic steering system.

FIG. 2 illustrates a perspective view of a rotary steerable drilling tool 200 with an electromagnetic steering system according to some embodiments of the present invention. The rotary steerable drilling tool 200 can include a drill collar 202, a bit shaft 212, an orientation control module 206, a mud tube 210, a mud tube coupler 208, a universal joint 207, mud sealing devices 204 and 214, and a drill bit 216. The bit shaft 212 can be mechanically coupled to the drill collar 202 through the universal joint 207 and the orientation control module 206. The bit shaft 212 can rotate about the universal joint 207, which can be acted as a pivot. The weight of the entire drill string and drill collar 202 can be loaded onto the drill bit 216 via the universal joint 207. The rotation torque of the drill collar 202 can be transmitted to the drill bit 216 through the universal joint 207 too. The orientation and the inclination angle of the bit shaft 212 against the drill collar 202 can be controlled by the orientation control module 206.

Figure 3:
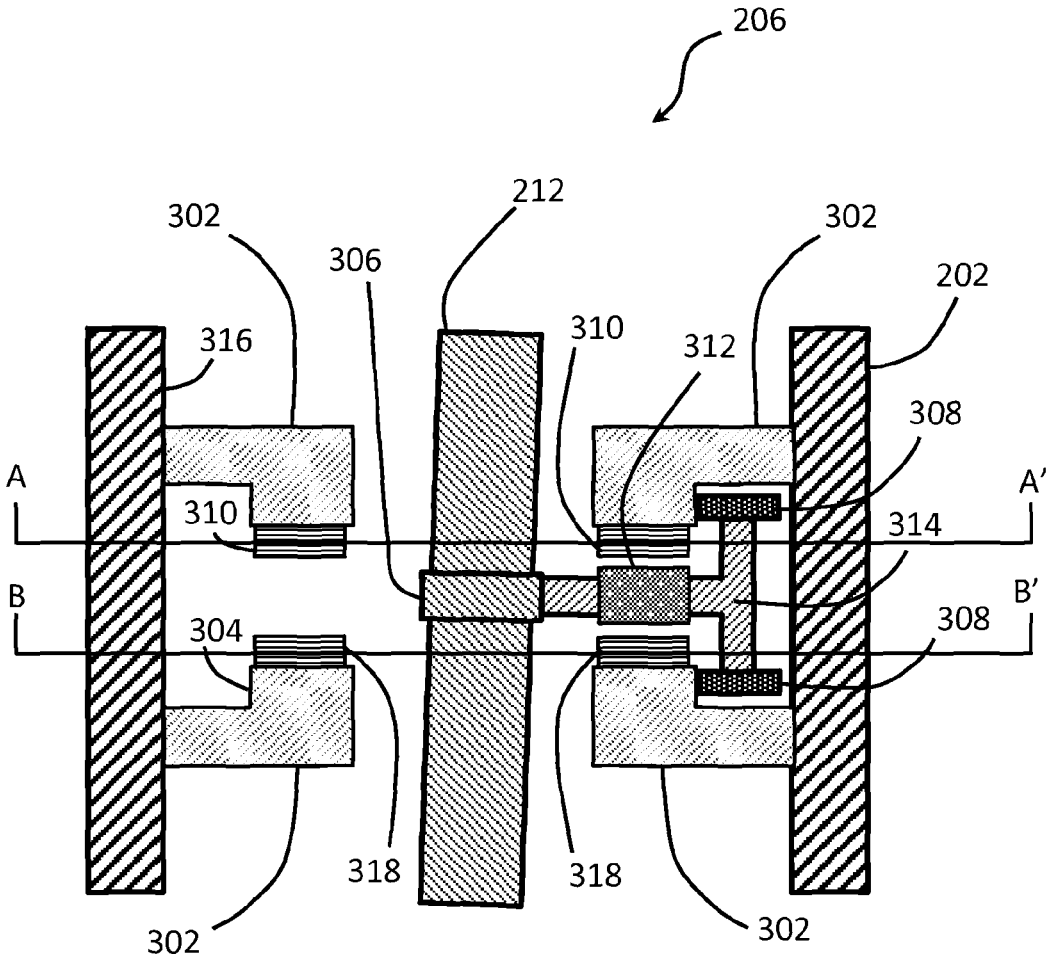
FIG. 3 illustrates an enlarged view of an orientation control module within the rotary steerable drilling tool shown in the FIG. 2.

FIG. 3 illustrates an enlarged view of the orientation control module 206 within the rotary steerable drilling tool 200 shown in the FIG. 2 according to some embodiments of the present invention. The orientation control module 206 can include a guide track 302 mounted on the inside wall 316 of the drill collar 202, a first array of electromagnets 310 mounted on the upper part of the guide track 302, a second array of electromagnets 318 mounted on the lower part of the guide track 302, a positioning frame 314, an array of permanent magnets 312 coupled to the positioning frame 314, a coupling tube 306, and at least two bearing wheels 308. The orientation control module 206 can be coupled to the bit shaft 212 through the positioning frame 314. The positioning frame 314 can have a horizontal arm and a vertical arm to form a T-shape structure.

In some embodiments, the guide track 302 can be made of high magnetic permeability metal to facilitate the magnetic flux passing through.

In some embodiments, the first and second arrays of the electromagnets 310 and 318 can be coils.

The positioning frame 314 can control the orientation of the bit shaft 212 and geo-direction of the drill bit 216 by 1) pulling/pushing the bit shaft 212 to incline with respect to the drill collar 202 about the universal joint 208; 2) adjusting the length of its horizontal arm to determine the inclination angle of the bit shaft 212 with respect to the drill collar 212; and 3) rotating along the guide track 302. The movement of the positioning frame 314 can be driven by the interaction between the first and second arrays of electromagnets 310 and 318 and the array of permanent magnets 312.

Figure 4A:
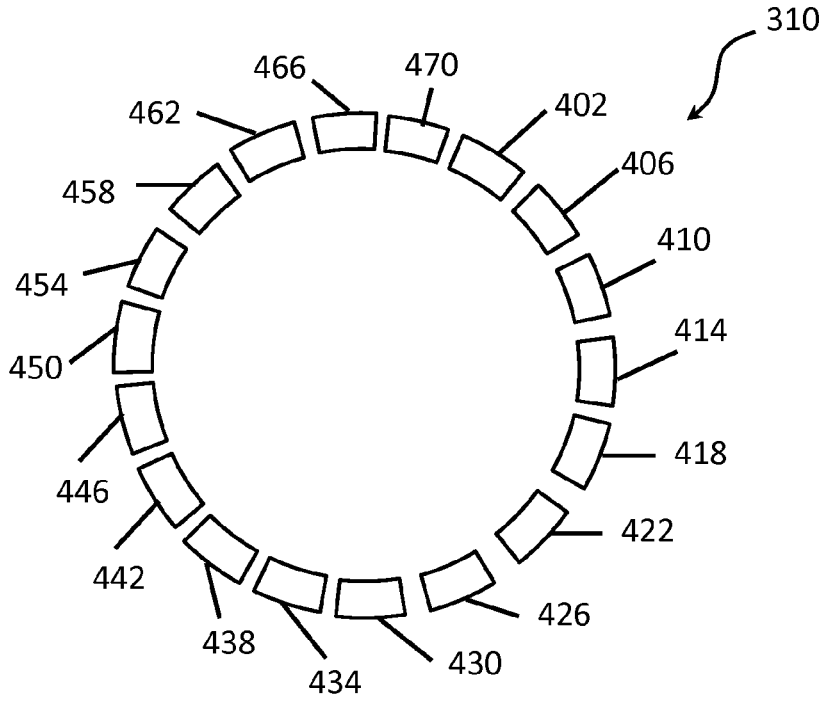
FIG. 4A is a cross-sectional view of the first array of the electromagnets along the line AA' in the FIG. 3.

FIG. 4A is a cross-sectional view of the first array of the electromagnets 310 along the line AA' in the FIG. 3 according to some embodiments of the present invention.

The first array of electromagnets 310 can include electromagnets 402, 406, 410, 414, 418, 422, 426, 430, 434, 438, 442, 446, 450, 454, 458, 462, 466, and 470. Preferably, the first array of electromagnets can have at least four electromagnets.

Figure 4B:
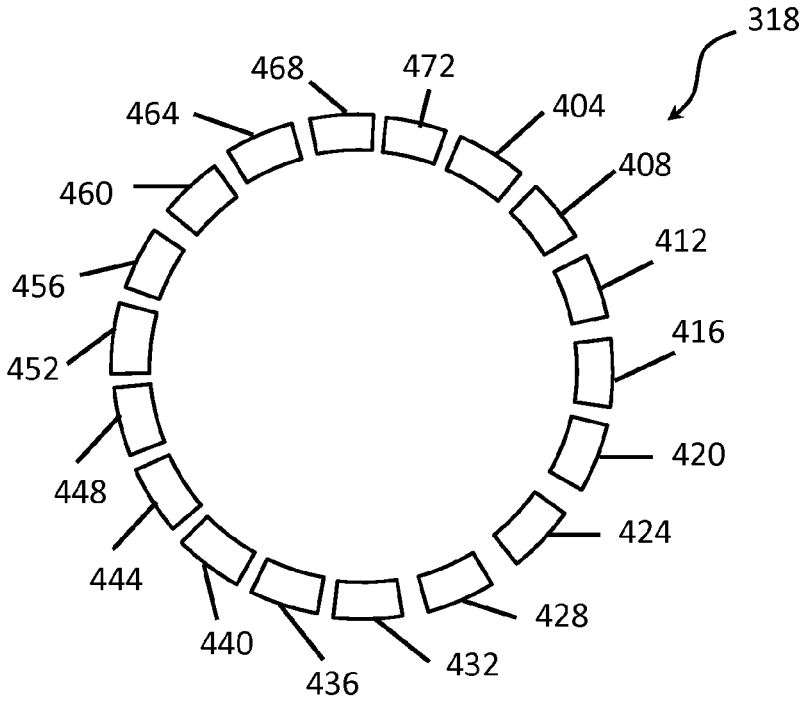
FIG. 4B is a cross-sectional view of the second array of the electromagnets along the line BB' in the FIG. 3.

FIG. 4B is a cross-sectional view of the second array of the electromagnets 318 along the line BB' in the FIG. 3 according to some embodiments of the present invention. The second array of electromagnets 318 can include electromagnets 404, 408, 412, 416, 420, 424, 428, 432, 436, 440, 444, 448, 452, 456, 460, 464, 468, and 472. Preferably, the second array of electromagnets can have at least four electromagnets.

In some embodiments, the first and second arrays of electromagnets 310 and 318 can have identical number of electromagnets and be aligned in both radial and azimuthal directions.

The present invention is in no way limited to any particular number and type of the electromagnets and permanent magnets.

Figure 5A:
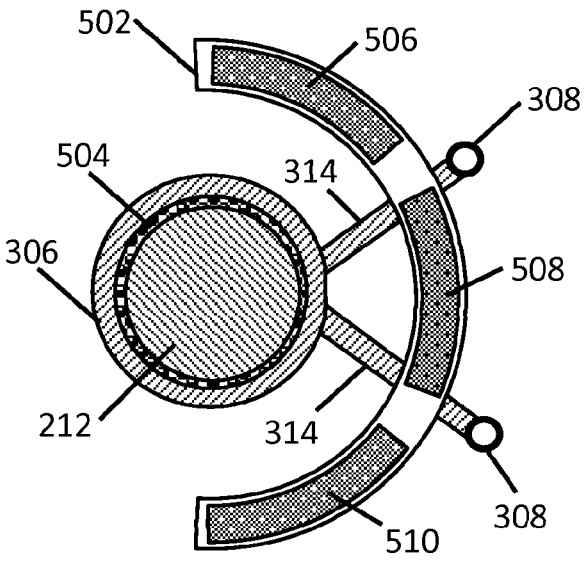
FIG. 5A illustrates a top view of the positioning frame coupled to the bit shaft as shown in the FIG. 3.

FIG. 5A illustrates a top view of the positioning frame 314 coupled to the bit shaft 212 as shown in the FIG. 3 according to some embodiments of the present invention. One end of the positioning frame 314 can be coupled to the bit shaft 212 through the coupling tube 306 and the other end of the positioning frame 314 can be coupled to the guide track 302 (not shown in the FIG. 5A) through the bearing wheel 308. The coupling tube 306 can be coupled to the bit shaft 212 through a set of bearings 504. The positioning frame 314 and the coupling tube 306 can form into a mechanically rigid body and rotate along the guide track 302.

In some embodiments, the array of permanent magnets 312 shown in the FIG. 3 can be held by a permanent magnet holder 502, which can be mounted on the positioning frame 314 and be made of nonmagnetic metal. With the permanent magnet holder 502, the positioning frame 314 can hold more permanent magnets, for example, 506, 508, and 510 in the FIG. 5A.

In some embodiments, the array of permanents magnet 312 can be radially aligned with the first and second arrays of electromagnets 310 and 318 to generate maximum magnetic force.

In operation, the positioning frame 314 can be driven to rotate along the guide track 302 by the magnetic force generated between the array of permanent magnets 312 and the first and second arrays of electromagnets 310 and 318. While drilling, the positioning frame 314 is rotating in the direction in opposite to the rotation direction of the drill collar 202 and the drill bit 216, but at the same frequency of the rotation of the drill collar 202 and drill bit 216.

Figure 5B:
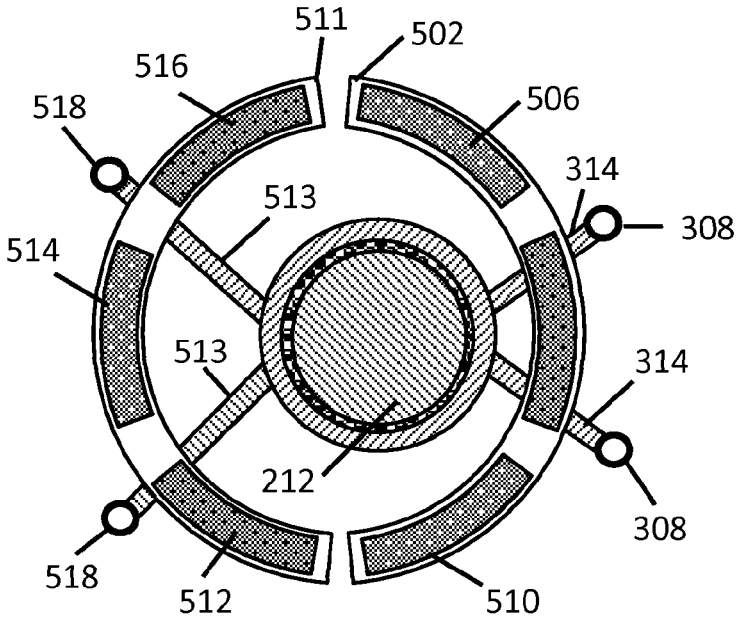
FIG. 5B illustrates a top view of another arrangement of the positioning frame, the bit shaft, and the permanent magnet.

FIG. 5B illustrates a top view of another arrangement of the positioning frame, the bit shaft, and the permanent magnet according to some embodiments of the present invention. Additional positioning frames 513, bearing wheels 518, permanent magnet holder 511, and permanent magnets 516, 514, and 512 can be coupled to the bit shaft 212 to increase the driving force applied to it.

In some embodiments, the shapes and sizes of the additional permanent magnets 512, 514, and 516 can be identical to them of the permanent magnets 506, 508, and 510.

Figure 6:
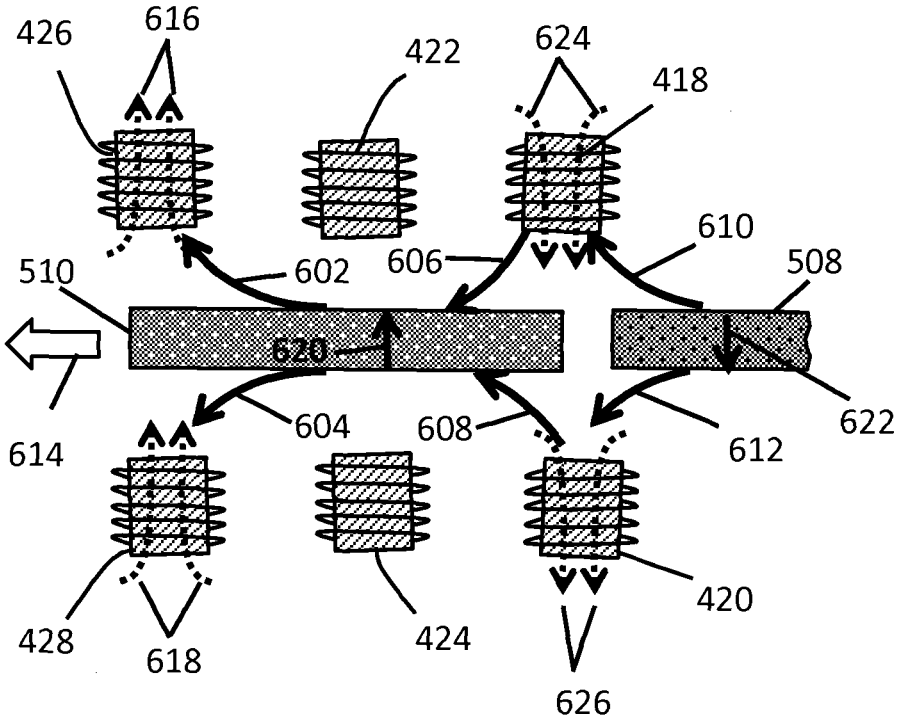
FIG. 6 illustrates a diagram showing the magnetic force interaction between the permanent magnets and electromagnets.

FIG. 6 illustrates a diagram showing the magnetic force interaction between the permanent magnets and electromagnets according to some embodiments of the present invention. For the illustration purpose, only six electromagnets 418, 420, 422, 424, 426, and 428 and two permanent magnets 508 and 510 are shown in the FIG. 6. The permanent magnets 508 and 510 can be magnetized in upward direction 620 and in downward direction 622 respectively. According to the law of electromagnetism, magnets with opposite poles should attract each other and magnets with like poles should repel each other. In order to move permanent magnets 508 and 510 toward left in the direction 614, the electromagnets 426 and 428 can be energized to generate upward-going magnetic flux 616 and 618 respectively. Both electromagnets 426 and 428 then can generate pulling forces 602 and 604 on the permanent magnet 510 accordingly to pull the permanent magnet 610 toward left. Similarly, the electromagnets 418 and 420 can be energized to generate downward-going magnetic flux 624 and 626 respectively. Both electromagnets 418 and 420 then can generate pushing forces 606 and 608 accordingly to push the permanent magnet 510 toward left. The electromagnets 422 and 424 stay idle and are positioned in the middle of the permanent magnet 510 at this stage and can not apply much force to the permanent magnet 510.

The permanent magnets 508 and 510 can be moved toward right when the control voltage applied to the electromagnets 418, 420, 426, and 428 are reversed in polarity.

In some embodiments, a hall sensor (not shown in the FIG. 6) can be coupled to the electromagnetic steering system to accurately determine the relative position between the permanent magnets and electromagnets, so that the accurate voltage can be computed and applied to the electromagnets while the a rotary steerable drilling tool is operating.

Figure 7:
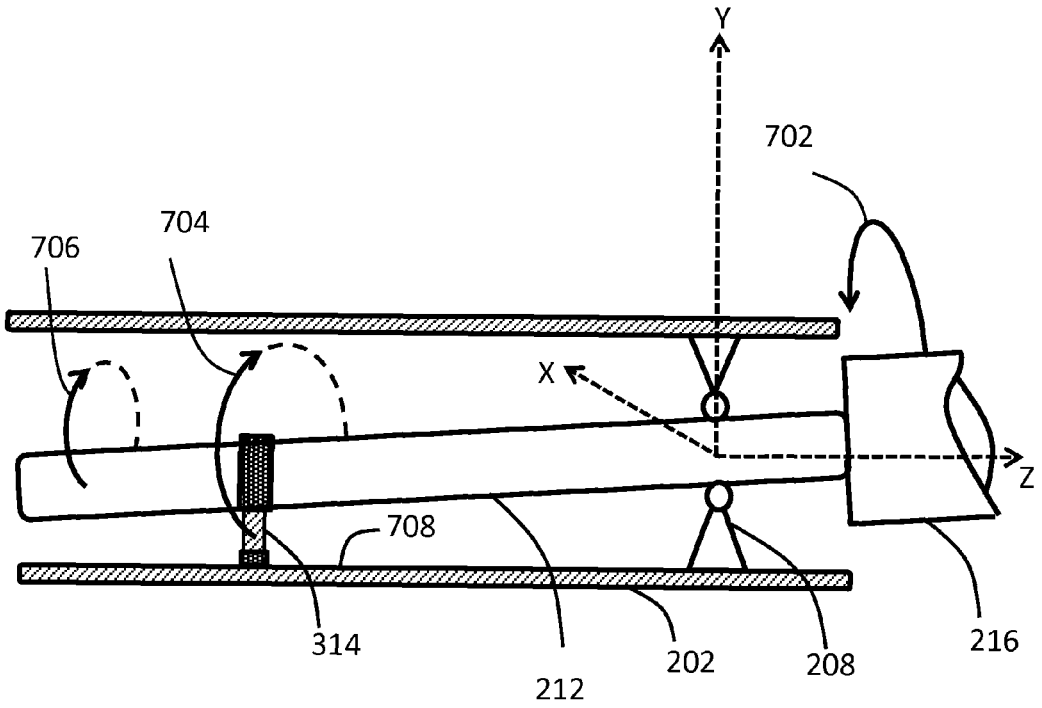
FIG. 7 illustrates the working mechanism of the rotary steering system.

FIG. 7 illustrates the working mechanism of the rotary steering system according to some embodiments of the present invention. As described above, the positioning frame 314 can control the orientation of the bit shaft 212 and azimuthal position of the drill bit 216 by 1) pulling/pushing the bit shaft 212 to incline with respect to the drill collar 202 about the universal joint 208; 2) adjusting the length of its horizontal arm to determine the inclination angle of the bit shaft 212 with respect to the drill collar 212; and 3) rotating along the guide track 302. The movement of the positioning frame 314 can be driven by the interaction between the first and second arrays of electromagnets 310 and 318 and the array of permanent magnets 312. For example, when the positioning frame 314 stays in the direction of the negative y-axis, the drill bit 216 moves towards the direction of the positive y-axis. For another example, when the drilling direction is set towards the direction of the positive x-axis, the positioning frame 314 shall stay in the direction of the negative x-axis.

During the well drilling process, if the drill collar 202 and the drill bit 216 constantly rotate in the direction 702 and the positioning frame 314 stays at a fixed position with respect to the drill collar 202, the drill bit 216 would wobble around the z-axis and drill a relatively larger bore hole. To drill in the desired direction, the geo-stationary orientation of the drill bit 216 is required. For instance, when the drill collar 202 and the drill bit 216 rotate in the direction 702, the drill bit 216 is expected to point to the direction of the positive y-axis constantly. To keep the bit shaft 212 and the drill bit 216 stay stationary with respect to the formation, the positioning frame 214 shall rotate in the direction 704 which is in opposite to the drill bit rotation direction 702, but at the same frequency of the rotation of the drill collar 202 and drill bit 216. The electromagnetic steering system, including the permanent magnets and the electromagnets, can control the position and rotation speed of the positioning frame 314 to eventually control the drilling direction of the wellbore.

Figure 8:
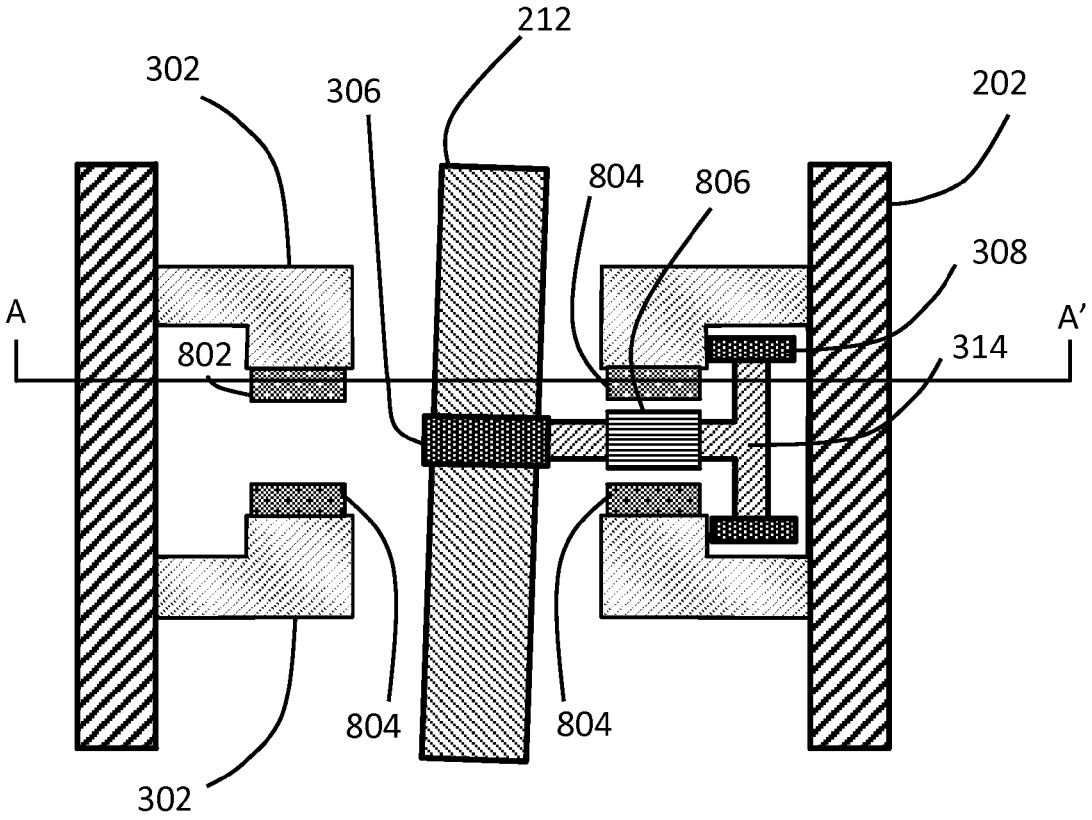
FIG. 8 illustrates another deployment of the orientation control module shown in the FIG. 2.

FIG. 8 illustrates another deployment of the orientation control module 206 shown in the FIG. 2 according to some embodiments of the present invention. The position of the permanent magnet and the electromagnets are switched. Permanent magnets 802 and 804 now can be mounted on the guide track 302. An array of electromagnets 806 can be installed on the positioning frame 314.

Figure 9:
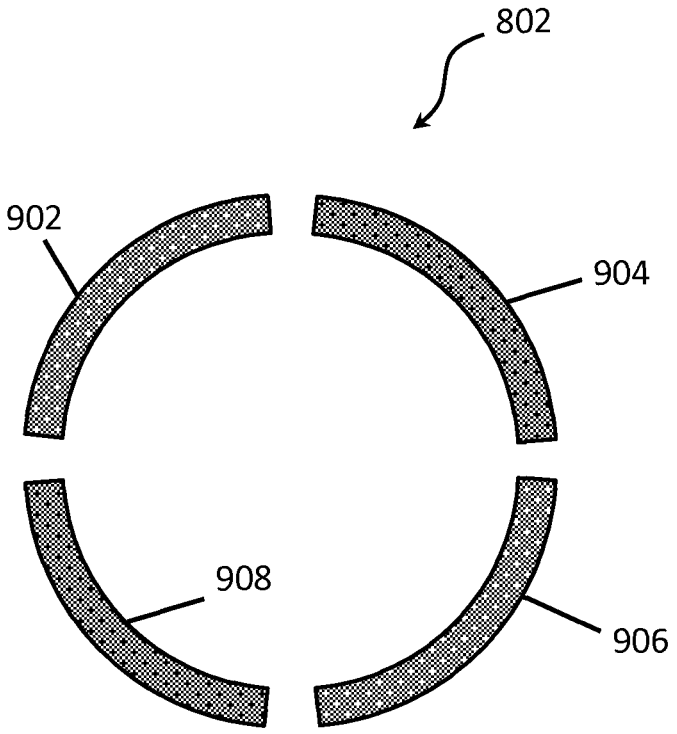
FIG. 9 is a cross-sectional view of the array of the permanent magnets along the line AA' in the FIG. 8.

FIG. 9 is a cross-sectional view of the array of the permanent magnets 802 along the line AA' in the FIG. 8 according to some embodiments of the present invention. The array of permanent magnets 802 can include electromagnets 902, 904, 906, and 908. Preferably, the array of permanent magnets 802 can have at least two permanent magnets.

In some embodiments, the polarization of the permanent magnets can be alternate along the guide track 302. For instance, when the permanent magnets 902 and 906 have their north poles facing upward, the permanent magnets 904 and 908 would have their north poles facing downward to facilitate the electromagnetic operation.

In some embodiments, the deployment of the array of permanent magnets 804 can be identical to it of the array of permanent magnets 802.

Figure 10A:
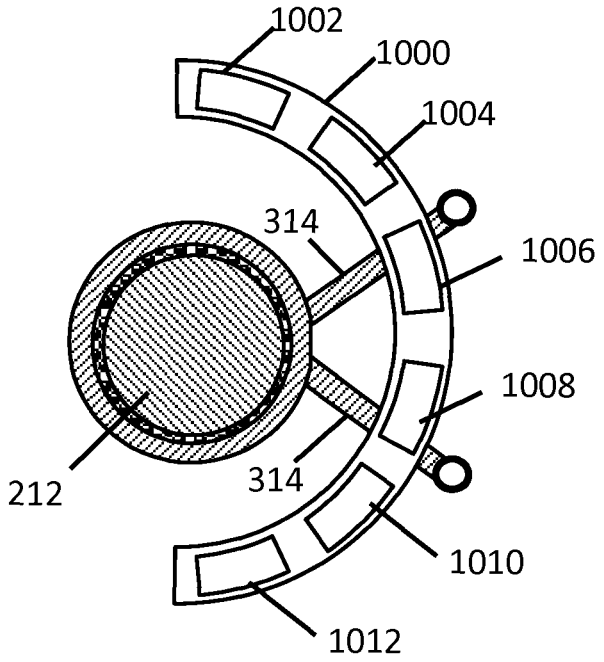
FIG. 10A illustrates a top view of the positioning frame with the array of electromagnets shown in the FIG. 8 coupled to the bit shaft.

FIG. 10A illustrates a top view of the positioning frame 314 with the array of electromagnets 806 shown in the FIG. 8 coupled to the bit shaft 212 according to some embodiments of the present invention. The array of electromagnets 806 shown in the FIG. 8 can be held by an electromagnet holder 1000, which can be mounted on the positioning frame 314 and be made of nonmagnetic metal. With the electromagnet holder 1000, the positioning frame 314 can hold more electromagnets at the same time, for example, 1002, 1004, 1006, 1008, 1010, and 1012.

Figure 10B:
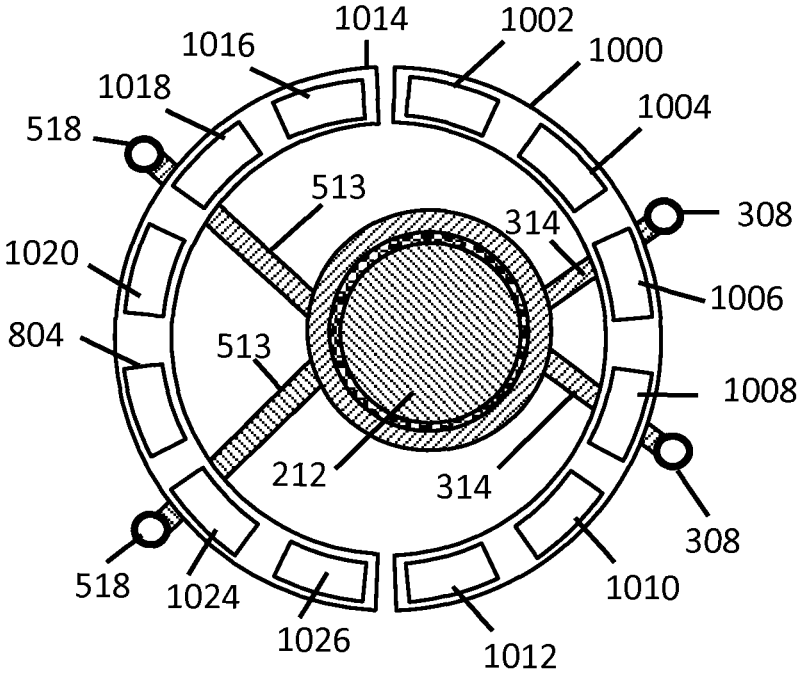
FIG. 10B illustrates another arrangement of the positioning frame, array of electromagnets, and the bit shaft.

FIG. 10B illustrates another arrangement of the positioning frame, array of electromagnets, and the bit shaft according to some embodiments of the present invention. Additional positioning frames 513, bearing wheels 518, electromagnet holder 1014, and electromagnets 1016, 1018, 1020, 1022, 1024, and 1026 can be also coupled to the bit shaft 212 to increase the driving force applied to it.

In some embodiments, a connecting device, such as a slipper ring (not shown in the figures), can be applied to the electromagnetic steering system to transfer power from the positioning frame 314 to the array of electromagnets 806.

In some embodiments, the shapes and sizes of the additional electromagnets 1016, 1018, 1020, 1022, 1024, and 1026 can be identical to them of the electromagnets 1002, 1004, 1006, 1008, 1010, and 1012.

The present invention has been described in terms of specific embodiments incorporating details to facilitate the understanding of principles of construction and operation of the invention. It will be readily apparent to one skilled in the art that other various modifications may be made in the embodiment chosen for illustration without departing from the spirit and scope of the invention as defined by the claims.

What is claimed is:

1. An orientation control module comprising:

a guide track mounted on the inside wall of a drill collar, said guide track having an upper part and a lower part, a first array of electromagnets mounted to the upper part of the guide track, a second array of electromagnets mounted to the lower part of the guide track, a positioning frame positioned between the upper part of the guide track and the lower part of the guide track, said positioning frame further comprising:

one or more bearing wheels disposed at the end of the positioning frame, an array of permanent magnets coupled to the positioning frame, said permanent magnets positioned to interact operably with said first array of electromagnets and second array of electromagnets.

2. A rotary steerable drilling tool with an electromagnetic steering system, comprising:

A drill collar, a bit shaft; and, an orientation control module, said orientation module further comprising:

a guide track mounted on the inside wall of the drill collar, said guide track having an upper part and a lower part, a first array of electromagnets mounted to the upper part of the guide track, a second array of electromagnets mounted to the lower part of the guide track, a positioning frame positioned between the upper part of the guide track and the lower part of the guide track, said positioning frame further comprising:

one or more bearing wheels disposed at the end of the positioning frame, an array of permanent magnets coupled to the positioning frame, said permanent magnets positioned to interact operably with said first array of electromagnets and second array of electromagnets, wherein said orientation control module is mechanically coupled to the bit shaft.

3. The rotary steerable drilling tool of claim 2, further comprising a pivot.

4. The rotary steerable drilling tool of claim 2, further comprising at least one mud sealing device.

5. The orientation control module of claim 1, wherein the electromagnets are shaped like coils.

6. The orientation control module of claim 1, wherein the first array and the second array each have at least 4 electromagnets, respectively.

7. The orientation control module of claim 1, further comprising a hall sensor which determines the relative position between the permanent magnets and the electromagnets.

8. The orientation control module of claim 7, wherein the electromagnets are shaped like coils.

9. The orientation control module of claim 7, wherein the first array and the second array each have at least 4 electromagnets, respectively.

* * * * *